US007802404B2

(12) United States Patent
Wolfram

(10) Patent No.: US 7,802,404 B2
(45) Date of Patent: Sep. 28, 2010

(54) CONNECTOR FOR GEODESIC DOME STRUCTURES

(76) Inventor: Blair F. Wolfram, 11480 - 141st Ave. North, Dayton, MN (US) 55327

( * ) Notice: Subject to any disclaimer, the term of this patent is extended or adjusted under 35 U.S.C. 154(b) by 439 days.

(21) Appl. No.: 11/849,663

(22) Filed: Sep. 4, 2007

(65) Prior Publication Data

US 2009/0056239 A1 Mar. 5, 2009

(51) Int. Cl.
*E04B 7/08* (2006.01)

(52) U.S. Cl. ..... 52/81.3; 52/81.1

(58) Field of Classification Search ..... 52/81.1, 52/81.3, 646, 648.1, 655.1, 656.9, 698, 712, 52/81.2; 135/121, 135, 159; 403/169, 170, 403/171, 172, 174, 175, 176, 178, 217
See application file for complete search history.

(56) References Cited

U.S. PATENT DOCUMENTS 4,370,073 A * 1/1983 Ohme ..... 403/172
4,449,843 A * 5/1984 Wendel ..... 403/173
4,491,437 A * 1/1985 Schwartz ..... 403/172
4,511,278 A 4/1985 Robinson
4,566,818 A 1/1986 Schwartz et al.
4,578,920 A 4/1986 Bush et al.
4,904,108 A * 2/1990 Wendel ..... 403/173
5,046,883 A 9/1991 Ezra
5,244,001 A 9/1993 Lynch
5,361,794 A 11/1994 Brady
5,421,356 A 6/1995 Lynch
5,423,341 A 6/1995 Brady
6,240,940 B1 6/2001 Carter
6,397,872 B1 6/2002 Carter
6,431,193 B2 8/2002 Carter
6,701,691 B1 3/2004 Niiduma
6,748,963 B2 6/2004 Carter
6,807,780 B2 * 10/2004 McCahill et al. ..... 52/220.8

OTHER PUBLICATIONS

"Dome Inc'S Complete Product List 2007," *Dome Incorporated*, 2 pgs.
Dome Incorporated Letter, 2 pgs.
"Domes for Everyone," *Dome Incorporated*, 2 pgs.
"Hurricane Buildings / Triangle Windows," *Dome Incorporated*, 2 pgs.
"The Geodesic Dome," *Dome Incorporated*, 2 pgs.

* cited by examiner

*Primary Examiner*—Brian E Glessner
*Assistant Examiner*—Patrick Maestri
(74) *Attorney, Agent, or Firm*—Dicke, Billig & Czaja, PLLC

(57) ABSTRACT

A dome connector including a hub portion and at least one pair of strut portions. The at least one pair of strut portions attached to and extending from the hub portion. Each of the strut portions has an upper end, a lower end and an intermediate region between the upper end and the lower end. The intermediate region has a greater thickness than the upper end and the lower end.

17 Claims, 3 Drawing Sheets

CONNECTOR FOR GEODESIC DOME STRUCTURES

FIELD OF THE INVENTION

The invention relates generally to geodesic domes. More particularly, the invention relates to connectors for use in geodesic domes.

BACKGROUND OF THE INVENTION

Geodesic domes not only have unique appearances but also have numerous structural advantages over conventional buildings. For example, it takes less building material to enclose a space in a dome than any other shape structure.

The structure of the dome is entirely supported by the outside wall. Since no inside bearing walls are required, there is greater flexibility in configuring the space inside of the dome.

Since domes use less surface area to enclose a space, they are more efficient at insulating the space. The vaulted ceilings in dome buildings allows for excellent air circulation and heat recovery.

Domes exhibit a tremendous ability to support snow loads. The shape of the dome also resists the effects of extreme weather conditions as the dome's aerodynamic shape reduces the affects of high winds, allowing gale force winds to slip by. The even distribution of weight in a dome also provides the dome with a low center of gravity that resists the effects of earthquakes.

SUMMARY OF THE INVENTION

An embodiment of the invention is directed to a dome connector having a hub portion and at least one pair of strut portions. The at least one pair of strut portions is attached to and extends from the hub portion. Each of the strut portions has an upper end, a lower end and an intermediate region between the upper end and the lower end. The intermediate region has a greater thickness than the upper end and the lower end.

DETAILED DESCRIPTION OF THE PREFERRED EMBODIMENTS

Figure 1:
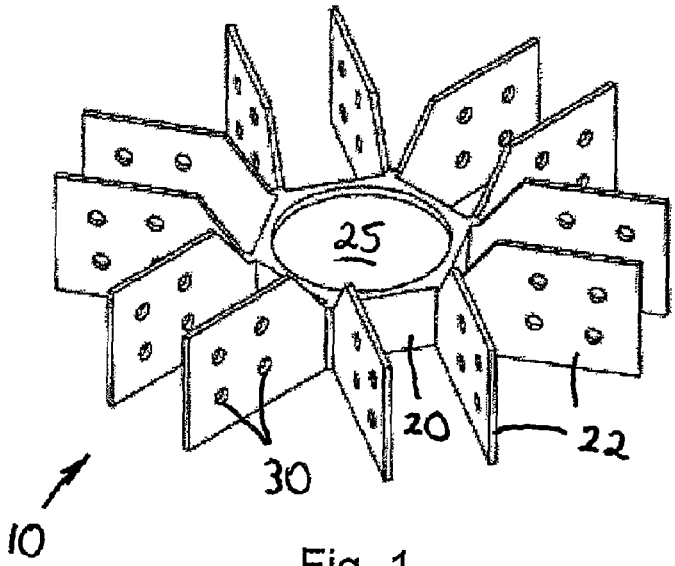
FIG. 1 is a perspective view of a dome connector according to an embodiment of the invention.
Figure 2:
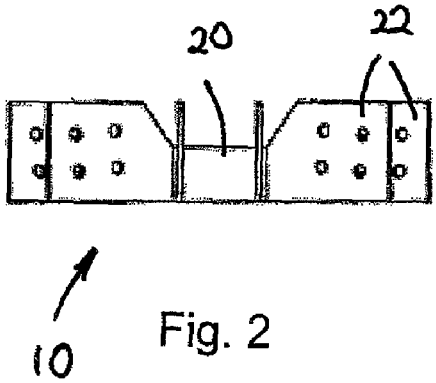
FIG. 2 is a side view of the dome connector.

The invention is a dome connector, illustrated as 10 in the Figures. The dome connector 10 is used in conjunction with side members 12 to fabricate structures that have a shape of at least a portion of a geodesic dome.

The dome connector 10 generally includes a hub portion 20 and a plurality of strut portions 22 extending therefrom. In one configuration of the dome connector 10, there are six pairs of strut portions 22 extending from the hub portion 20.

While the strut portions 22 are illustrated as being integrally formed to the hub portion 20 such as with casting, it is possible for the strut portions 22 to be fabricated separately from the hub portion 20 and then attached to the hub portion 20 such as with welding. The hub portion 20 and the strut portions 22 may be fabricated from a variety of materials, examples of which include aluminum, steel, plastic and wood. Preferred materials for fabricating the dome connector 10 include 356 non-tempered cast aluminum and 319 non-tempered cast aluminum.

While the hub portion 20 is illustrated as having a generally round configuration, the size and shape of the hub portion 20 may be dictated by the number of side members 12 that are attached to the hub portion 20 and the thickness of the side members 12. Depending on the application, a central section 25 of the hub portion 20 may be solid or open.

Figure 4:
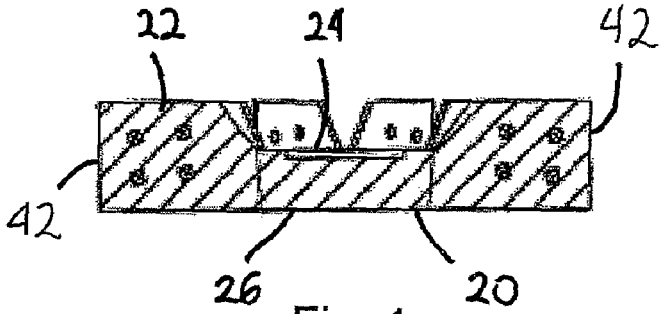
FIG. 4 is a sectional view of the dome connector taken along a line A-A in FIG. 3.
Figure 3:
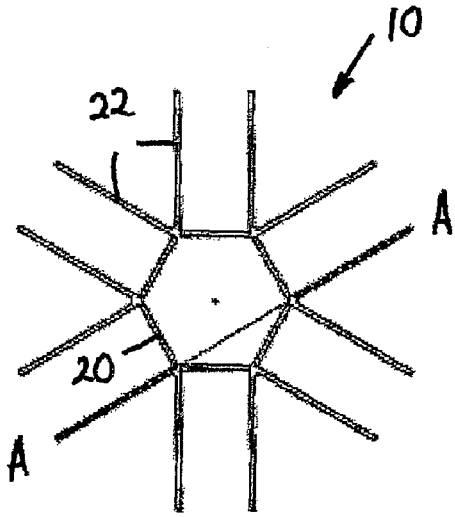
FIG. 3 is a top view of the dome connector.

In one configuration, the hub portion 20 is tapered so that a diameter of the hub portion 20 proximate an upper edge 24 thereof is larger than a diameter proximate a lower edge 26 thereof, as illustrated in FIG. 4. Tapering of the hub portion 20 enables a surface of the hub portion 20 to generally be aligned with an end surface of the side member 12 when the side member 12 is attached to the dome connector 10. The diameter of the hub portion 20 may be approximately 4 inches proximate the upper edge 24 and the diameter of the hub portion 20 may be approximately 3 inches proximate the lower edge 26.

The strut portions 22 may be provided in pairs and may be spaced apart at a distance that is approximately the same as a thickness of the side member 12 so that one of the side members 12 may be received between each pair of strut portions 22. The strut portions 22 in each pair may be oriented generally parallel to each other.

Figure 5:
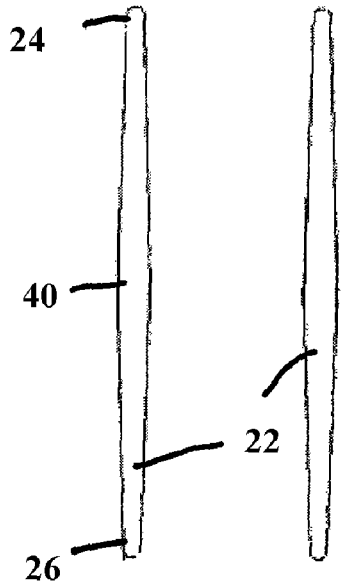
FIG. 5 is an end view of a pair of strut portions on the dome connector.

The strut portions 22 may be formed with a tapered configuration where the strut portion has a greater thickness proximate an intermediate region 40 thereof than proximate upper edge 24 and the lower edge 26 thereof, as illustrated in FIG. 5. In one configuration, a thickness of the strut portion 22 proximate the intermediate region 40 is approximately two times the thickness of the strut portion 22 proximate the upper edge 24 and the lower edge 26. The strut member 22 may have a thickness of about 5/16 of an inch proximate the intermediate region and about 5/32 of an inch proximate the upper 24 and the lower edge 26.

The strut portions 22 may have a height that is greater than a height of the hub portion 20. In one configuration, the height of the strut members 22 is approximately two times the height of the central region 20. For many applications, the strut portions 22 may have a height of up to 12 inches. Preferably, the strut portions 22 have a height of about 5 inches.

For many applications, a distance between an outer edge 42 of the strut portion 22 and the hub portion 20 may be up to about 12 inches proximate the upper edge 24 and preferably is about 7 inches. For many applications, a distance between an outer edge 42 of the strut portion 22 and the hub portion 20 may be up to about 12 inches proximate the lower edge 26 and preferably is about 7½ inches.

Each of the strut portions 22 may have a plurality of apertures 30 formed therein that may have a diameter of about 9/16 of an inch. In one configuration, each of the strut portions 22 includes four apertures 30 that are oriented in an array.

The apertures 30 may be oriented in a generally square pattern, as illustrated in the Figures. Such square pattern may be oriented at an angle with respect to at least one of the upper edge 24 and the lower edge 26. The angle may be up to 20 degrees and preferably about 11 degrees.

To provide the dome connector 10 with sufficient structural rigidity, the apertures 30 are spaced apart from each other and apart from edges of the strut portion 22 so that a distance between the center of adjacent apertures is at least twice a distance from a center of each aperture 30 to an edge of the strut portion 22. In one configuration, the apertures 30 are oriented so that a distance between a center of each aperture 30 to the edge of the strut portion 22 is at least one inch and a distance between centers of adjacent apertures 30 is at least two inches. The side members 12 may be fabricated from a variety of materials depending on the location in which the dome structure is being constructed. Examples of suitable materials that can be used to fabricate the side members 12 include wood, steel and wood-polymer composites. Preferred side members 12 for use in conjunction with the invention include kiln dried Douglas fir/larch or kiln dried southern yellow pine.

Dimensions of the side members 12 are selected based upon the size of the dome structure being fabricated from the dome connector 10 and side members 12 as well as the conditions that the dome structure will be subjected to such as snow loads and hurricanes. In one configuration, the side members have a thickness of about 1½ inches and a height of about 12 inches.

Figure 7:
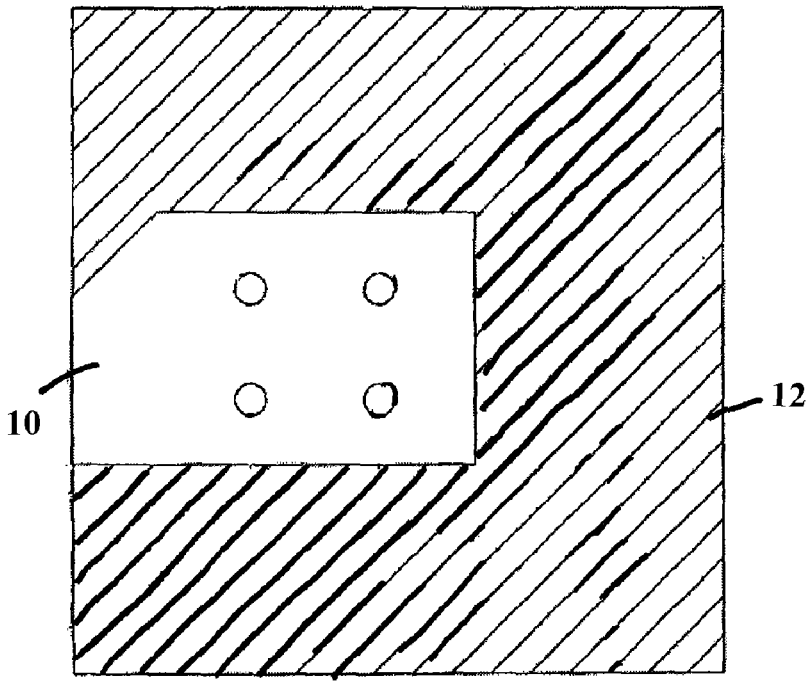
FIG. 7 is a side view of the dome connector attached to an alternative side member.
Figure 6:
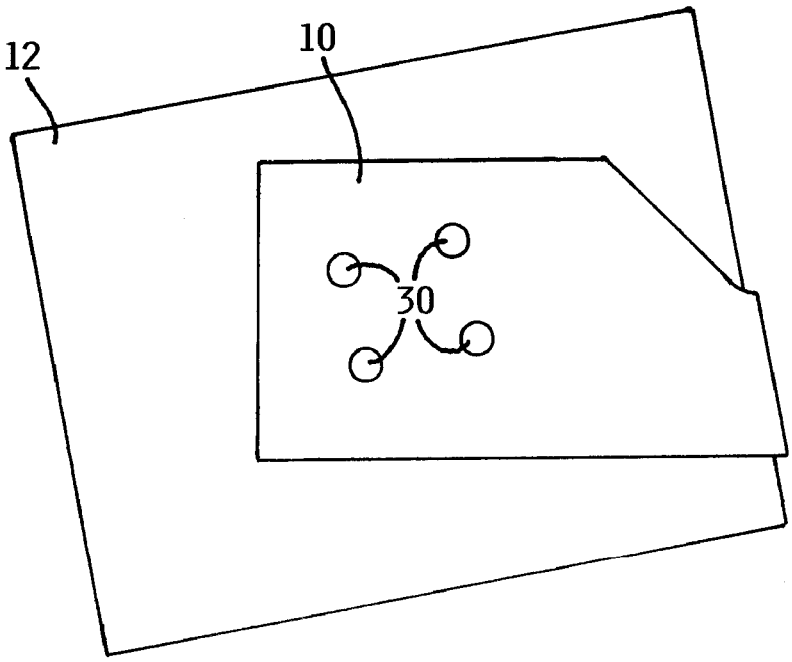
FIG. 6 is a side view of the dome connector attached to a side member.

When the side members 12 are attached to the strut portions 22, a distance between edges of the strut portion 22 is at least as large as a distance from the center of the aperture 30 to one of the edges of the strut portion, as illustrated in FIG. 6. In another configuration, which is illustrated in FIG. 7, the side member 12 is positioned with respect to the strut portion 22 so that a distance between an edge of the strut member and an edge of the side member 12 is at least as large as a distance between opposite edges of the strut portion 22.

Figure 8:
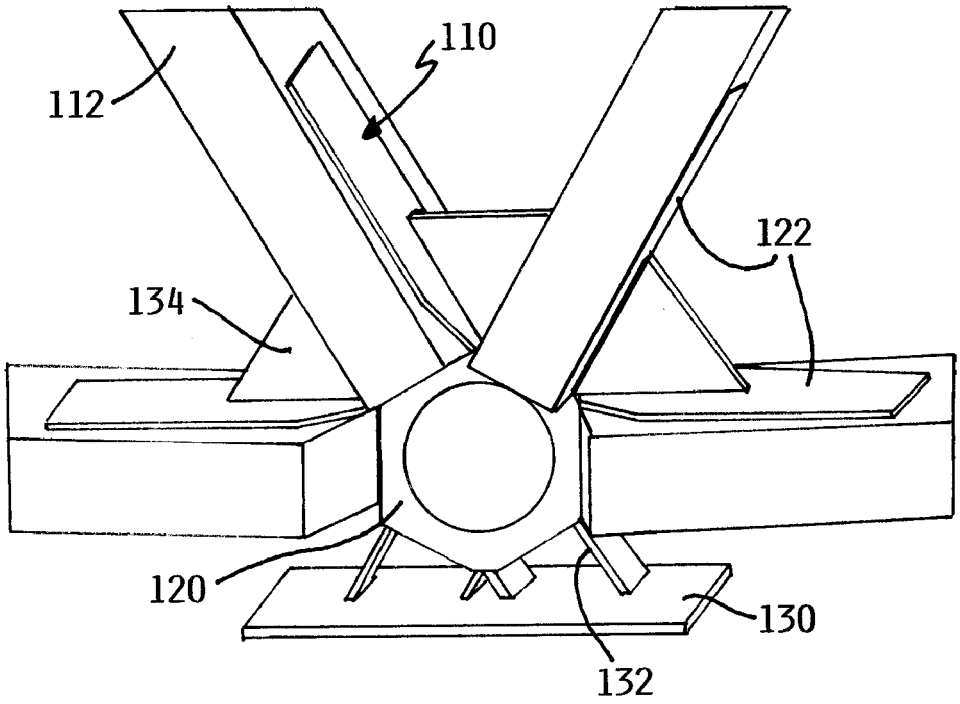
FIG. 8 is a perspective view of a dome connector according to an alternative embodiment of the invention.

In another configuration, the dome connector 110 includes a hub portion 120 and a plurality of strut portion 122 extending therefrom, as illustrated in FIG. 8. Unlike the version of the dome connector 10 illustrated in FIGS. 1-7, which is designed for placement in a central location on the dome structure, this configuration of the dome connector 110 is designed for placement along an edge of the dome structure to facilitate attachment of the dome structure to a support surface.

Instead of at least one pair of strut portions 122, the dome connector 110 includes a mounting plate 130. The mounting plate 130 has at least one aperture formed therein through which bolts can be placed.

The mounting plate 130 is attached to the hub portion 120 with at least one connector plate 132 such as with welding. As illustrated, the connector plates 132 may be oriented in a similar position and orientation as the strut portion 122.

The dome connector 110 (as well as the dome connector 10) may also include a web portion 134 that extends between strut portion 122. The web portion 134 extends at least partially along the length of the strut portion 122. The web portion 134 may be integrally fabricated with the other portions of the dome connector 110. Alternatively, the web portion 134 may be attached to the strut portions 122 such as with welding.

It is contemplated that features disclosed in this application, as well as those described in the above applications incorporated by reference, can be mixed and matched to suit particular circumstances. Various other modifications and changes will be apparent to those of ordinary skill.

The invention claimed is:

1. A dome connector comprising:

a hub portion; and at least one pair of strut portions attached to and extending from the hub portion, wherein each of the strut portions has an upper end, a lower end and an intermediate region between the upper end and the lower end, wherein sides of the strut taper from the intermediate region to the upper and lower regions so that the intermediate region has a greater thickness than the upper end and the lower end.

2. The dome connector of claim 1, wherein the thickness of the intermediate region is about two times the thickness proximate at least one of the upper ends and the lower ends.

3. The dome connector of claim 1, wherein each of the strut portions has a plurality of apertures formed therein and the apertures are oriented in an array.

4. The dome connector of claim 2, wherein each of the strut portions has four apertures formed therein and wherein the four apertures are oriented in a substantially square configuration.

5. The dome connector of claim 4, wherein the array is oriented at an angle of between 5 and 20 degrees with respect to at least one of the upper end and the lower end.

6. The dome connector of claim 1, wherein each of the strut portions has a length of at least about 7 inches and a height of at least about 5 inches.

7. The dome connector of claim 1, wherein the strut portions is defined by a plurality of edges, wherein a distance between the centers of adjacent apertures is at least twice a distance from a center of each aperture to each of the plurality of edges of the strut.

8. The dome connector of claim 1, wherein each of the strut portions has a height that is approximately two times a height of the hub portion.

9. The dome connector of claim 1, wherein a diameter of the hub portion proximate an upper edge thereof is greater than a diameter of the hub portion proximate a lower edge thereof.

10. A dome structure comprising:

a plurality of dome connectors comprising:

a hub portion; and a plurality of strut portions attached to and extending from the hub portion, wherein each of the strut portions is defined by a plurality of edges, wherein each of the strut portions has a plurality of apertures formed therein and the apertures oriented in an array, wherein the sides of the strut taper from an intermediate region to the upper and lower ends so that the intermediate region has a greater thickness than the upper and lower ends, wherein a distance between centers of adjacent apertures is approximately twice a distance from a center of each aperture to one of the edges of the strut portion;

a plurality of elongated dome members; and at least one fastener attaching one of the elongated dome members to each of the strut portions to define an enclosure, wherein a distance between edges of the strut portion and edges of the elongated dome member is at least as large as a distance from the center of each aperture to one of the edges of the strut portion.

11. The dome structure of claim 10, wherein the distance between edges of the strut portion and edges of the elongated dome member is approximately the same as the distance from the center of each aperture to one of the edges of the strut portion.

12. The dome structure of claim 10, wherein each of the strut portions has an upper end, a lower end and an intermediate region between the upper end and the lower end, wherein the intermediate region has a greater thickness than the upper end and the lower end, and wherein the thickness of the intermediate region is about two times the thickness proximate at least one of the upper ends and the lower ends.

13. The dome structure of claim 10, wherein each of the strut portions has four apertures formed therein and wherein the four apertures are oriented in a substantially square configuration.

14. The dome structure of claim 13, wherein the array is oriented at an angle of between 5 and 20 degrees with respect to at least one of the upper ends and the lower ends.

15. The dome structure of claim 10, wherein each of the strut portions has a length of at least about 7 inches and a height of at least about 5 inches.

16. The dome structure of claim 10, wherein each of the strut portions has a height that is approximately two times a height of the hub portion.

17. The dome structure of claim 10, wherein a diameter of the hub portion proximate an upper edge thereof is greater than a diameter of the hub portion proximate a lower edge thereof.

* * * * *